US006923775B1

(12) United States Patent
Wood

(10) Patent No.: US 6,923,775 B1
(45) Date of Patent: Aug. 2, 2005

(54) BODY STROKING APPARATUS

(76) Inventor: Sandra L. Wood, 3111 Poplar St., Marshall, TX (US) 75672

( * ) Notice: Subject to any disclaimer, the term of this patent is extended or adjusted under 35 U.S.C. 154(b) by 0 days.

(21) Appl. No.: 10/643,305

(22) Filed: Aug. 20, 2003

(51) Int. Cl.[7] ..... A61H 19/00
(52) U.S. Cl. ..... 601/117; 601/136
(58) Field of Search ..... 601/84–90, 93–103, 601/107–138

(56) References Cited

U.S. PATENT DOCUMENTS 3,078,843 A * 2/1963 Brisson ..... 601/101
3,403,674 A * 10/1968 Alimanestiano ..... 601/134
3,799,155 A * 3/1974 Gerlich ..... 601/103
4,041,938 A * 8/1977 Wintoniw ..... 601/101
5,016,617 A * 5/1991 Tarlow et al. ..... 601/117
5,109,912 A * 5/1992 Gary ..... 160/330
5,450,890 A * 9/1995 Pinkalla et al. ..... 160/121.1
5,916,182 A 6/1999 Fengler
6,074,353 A * 6/2000 Helmer ..... 601/136

* cited by examiner

*Primary Examiner*—Michael A. Brown
(74) *Attorney, Agent, or Firm*—Harrison & Egbert

(57) ABSTRACT

A body stroking apparatus having a housing with a channel extending longitudinally therealong, an arm extending outwardly from the housing through the channel and vertically upwardly therefrom, a crossbar extending outwardly transversely to the arm, a plurality of flexible members affixed to the crossbar and extending downwardly therefrom, and a translation mechanism for moving the arm back and forth along the channel. The plurality of flexible members can include a plurality of flexible strips, a plurality of beaded lines and a plurality of flexible strands. A mat can be provided with a surface suitable for receiving a human body thereon such that the mat is positioned against a side of the housing with the crossbar extending over a top of the mat.

9 Claims, 3 Drawing Sheets

BODY STROKING APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to stress reduction apparatus. More particularly, the present invention relates to devices for the touching and massaging of a human body. Additionally, the present invention relates to devices for providing a very light touching sensation against the human body.

BACKGROUND OF THE INVENTION

Massage devices are well known for tactile stimulation and for muscle relaxation. These massage devices are intended for applying a substantial pressure onto the bone or muscle structure of the human body. Often, the pressure is coupled with a vibratory sensation so as to further "loosen" the muscles and to provide for pleasing relaxation. However, under certain circumstances, persons do not desire to have the strong pressure applied by such massage devices. Often, persons desire to attain a tactile sensation which is much lighter and much softer for the stimulation of the human body and for stress reduction purposes.

In the past, it has been known to use feathers for caressing or tickling the body. However, other individuals are required so as to move these feathers in a desired position over the body. The use of such feathers and/or tickling devices have not generally been known to be accompanied with a mechanical method for moving these devices over the human body.

It is believed that the use of such very light tactile sensations achieves a great stress reduction effect. The longer that the light tactile sensations are applied to the human body, the greater the stress reduction.

In the past, various U.S. patents have issued relating to such massaging and tactile sensation devices. For example, U.S. Pat. No. 6,074,353, issued on Jun. 13, 2000 to Y. Helmer, describes a device for caressing the body. This device has strips of flexible soft material hanging from a horizontal support above the body. A motive source is used to move the horizontal support over the body so that the strips can contact the body with varying degrees of tactile sensitivity to caress, tickle, scratch, numb and create arousal sensations. The device is provided with an arm which is rotated in a circular pattern so that periodically, the strips of flexible material will contact the human body. The strips of flexible material do not travel a longitudinal path along the human body.

U.S. Pat. No. 5,916,182, issued on Jun. 29, 1999 to W. F. O. Fengler, describes a massaging apparatus stored under a bed which is movable to position over the bed. The massaging apparatus includes a mounting arm which can be moved from the space under the bed and pivoted to an upright position. When in the upright position, an elongated arm is connected to the mounting arm and pivotable in a direction toward and away from the bed. The elongated arm includes a massaging device mounted on its outer end. The massaging device is capable of being separately driven in a reciprocating manner. The elongated arm is appropriately counterbalanced so that the massaging device will apply a slight downward pressure onto the person who is being massaged.

It is an object of the present invention to provide a body stroking apparatus which achieves a stress reduction in the human body.

It is another object of the present invention to provide a body stroking apparatus which applies a very light tactile sensation to the human body.

It is a further object of the present invention to provide a body stroking apparatus which applies such a light tactile sensation along the length of the human body.

It is a further object of the present invention to provide a body stroking apparatus which allows the tactile sensation to move back and forth continually across the human body.

It is a further object of the present invention to provide a body stroking apparatus which can be easily used by a single individual.

It is a further object of the present invention to provide a body stroking apparatus which is easy to use, relatively inexpensive, and easy to manufacture.

These and other objects and advantages of the present invention will become apparent from a reading of the attached specification and appended claims.

BRIEF SUMMARY OF THE INVENTION

The present invention is a body stroking apparatus comprising a housing having a channel extending longitudinally therealong, an arm extending outwardly from the housing through the channel and vertically upwardly therefrom, a crossbar extending outwardly transversely to the arm, a plurality of flexible members affixed to the crossbar and extending downwardly therefrom, and a translation means for moving the arm back and forth along the channel.

In one embodiment of the present invention, the arm comprises a L-shaped member having a lower portion extending outwardly through the channel. The arm also can include a receptacle formed at the top of the L-shaped member and a rod detachably received in the top of the L-shaped member and extending vertically upwardly therefrom. The crossbar is attached to this rod.

In one embodiment of the present invention, the crossbar includes a clamp which is secured to this rod. The clamp serves to adjust a height of the crossbar along the rod.

The crossbar has a hook-and-loop material affixed to an exterior surface thereof. The plurality of flexible members have a surface with a strip of complementary hook-and-loop material secured to the hook-and-loop material of the crossbar. The plurality of flexible members can include a plurality of flexible strips extending downwardly from the crossbar, a plurality of beaded lines extending downwardly from the crossbar or a plurality of flexible strands extending downwardly from the crossbar. This plurality of flexible members extends downwardly from the crossbar for a distance less than the vertical length of the arm.

A mat with a surface suitable for receiving a human body thereon can be positioned adjacent to a side of the housing. The crossbar will extend over a top of the mat.

BRIEF DESCRIPTION OF THE VIEW OF THE DRAWING

DETAILED DESCRIPTION OF THE INVENTION

Figure 1:
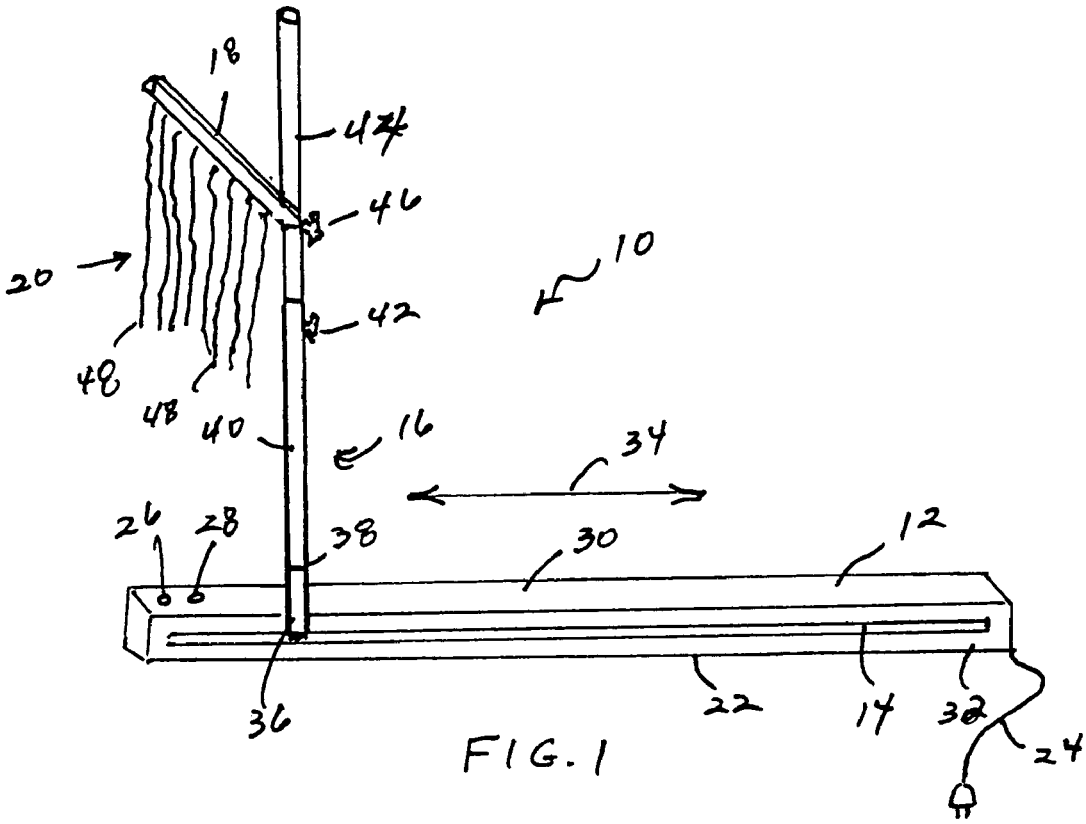
FIG. 1 is an interior perspective view of the body stroking apparatus of the present invention.

Referring to FIG. 1, there is shown the body stroking apparatus 10 in accordance with the preferred embodiment of the present invention. The body stroking apparatus 10 includes a housing 12 having a channel 14 extending longitudinally therealong. An arm 16 extends outwardly from the housing 12 through the channel 14 and vertically upwardly therefrom. A crossbar 18 is affixed to the arm 16 and extends transversely outwardly therefrom. A plurality of flexible members 20 are affixed to the crossbar 18 and extend downwardly therefrom. The housing 12 is provided with a suitable translation mechanism for moving the arm 16 back and forth along the channel 14.

In FIG. 1, it can be seen that the housing 12 has a generally elongated square tubical configuration with a flat bottom surface 22. The flat bottom surface 22 allows the housing 12 to easily rest on any flat surface in a stable manner. An electrical cord 24 will extend outwardly from the housing 12 so as to supply electrical energy to the translation mechanism on the interior of the housing 12. A suitable speed control 26 and a timer 28 can be provided on the top surface 30 of the housing 12. The speed control 26 can be used to control the rate at which the translation mechanism moves the arm 16 back and forth through the channel 14. The timer 28 can be used to set the amount of time in which the device is being used.

The channel 14 is a slot which is provided on the side 32 of the housing 12. The channel 14 will generally face the user. The crossbar 18 extends outwardly of the arm 16 on the side of the housing 12 with the channel 14 formed thereon. The arm 16 will move back and forth in the channel 14 in the manner illustrated by arrow 34.

Various mechanisms can be used for the translation mechanism which is included in the interior of the housing 12. For example, in one form of the present invention, the translation mechanism can be a cable mounted over a pair of sheaves in the interior of the housing 12. The sheaves can be rotated so as to move the cable back and forth. A suitable car-type mechanism can be joined to the inner end of the arm 16 so as to move the arm 16 back and forth. When the arm 16 contacts certain limits which is within the interior of the housing, the motor will reverse directions of the cable movement of the cable. Alternatively, a worm gear can be provided on the interior of the housing 12. The worm gear can be rotated in one direction so as to cause the arm 16 to move rearwardly and rotated in the other direction so as to cause the arm to move forwardly. The motor connected to the worm gear can be reversed so as to drive the arm 16 in its desired back and forth directions. Suitable limit switches can be provided so as to limit the travel of the arm 16 within the housing 12. It is believed that, within the concept of the present invention, various other types of translation mechanisms can be utilized which are known in the art.

The arm 16 includes an L-shaped member 36 which has a lower portion extending outwardly through the channel 14. A receptacle 38 is formed at the top of the L-shaped member 36. A rod 40 can be detachably received in the top of the L-shaped member 36 so as to extend upwardly therefrom. The crossbar 18 will be affixed to this rod 40. A suitable locking mechanism 42 can be provided so that the rod 40 can telescope. As can be seen in FIG. 1, the crossbar 18 is clamped to the upper portion 44 of the rod 40. The rotation of the knob 42 will lock the telescoping rod 40 into its desired position and desired vertical height.

The crossbar 18 includes a clamp 46 which is secured to the upper portion 44 of rod 40. The clamp allows for an adjustment of the crossbar with respect to the rod 40.

As can be seen in FIG. 1, the plurality of flexible members 20 extend downwardly from the crossbar 18 for a length less than the vertical height of the rod 40. In FIG. 1, the plurality of flexible members includes a plurality of flexible strands 48. However, as will be described hereinafter, various other flexible members can be secured to the crossbar 18 so as to achieve a desired effect.

Figure 2:
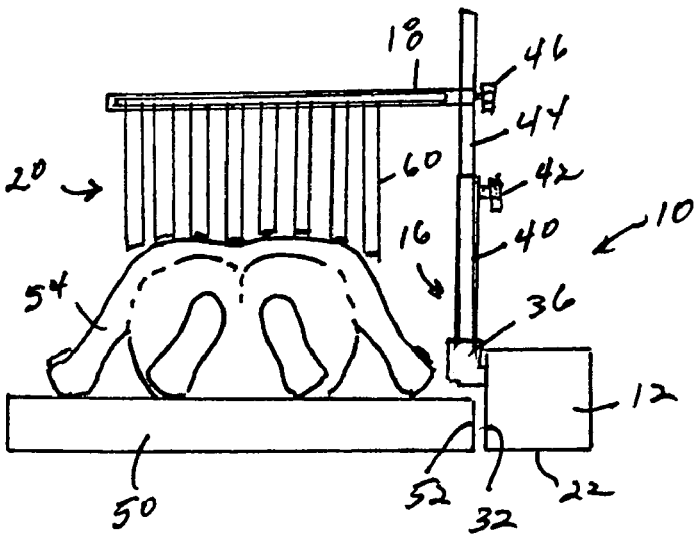
FIG. 2 is an end view showing the operation of the body stroking apparatus of the present invention.

FIG. 2 shows the operation of the apparatus 10 of the present invention. As can be seen in FIG. 2, the housing 12 has the L-shaped member 36 extending outwardly therefrom. The rod 40 is received within the receptacle formed at the top of the L-shaped member 36. Knob 42 is used so as to control the height of the telescoping upper portion 44 associated with rod 40. The crossbar 18 is secured by clamp 46 to the upper portion 44 of rod 40. The plurality of flexible members 20 extend downwardly from the crossbar 18. In the embodiment shown in FIG. 2, the plurality of flexible members 20 include a plurality of flexible strips extending downwardly in general parallel relationship to each other.

In FIG. 2, it can be seen that a mat 50 is positioned on the same flat surface that the flat bottom surface 22 of housing 12 is placed. The side 32 of the housing 12 is placed adjacent to the side 52 of the mat 50. In this arrangement, the person 54 is in a suitable position for receiving the effect of the body stroking apparatus 10. The person 54 is shown as laying on the top surface of the mat 50 adjacent to the side 32 of the housing 12.

The arm 16 will translate back and forth in the channel 14 so that the plurality of flexible strips 60 will gently glide over the back of the human being 54 in a soft caressing manner. As such, the present invention will provide a very soft tactile sensation to the human being 54. This will create a significant stress reduction in the human body.

Figure 3:
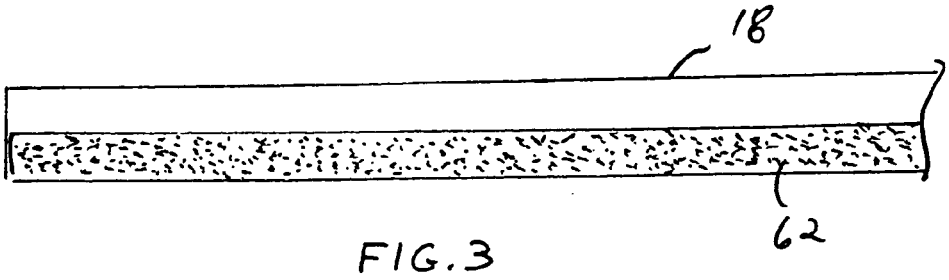
FIG. 3 is a detailed view showing the surface of the crossbar associated with the present invention.
Figure 4:
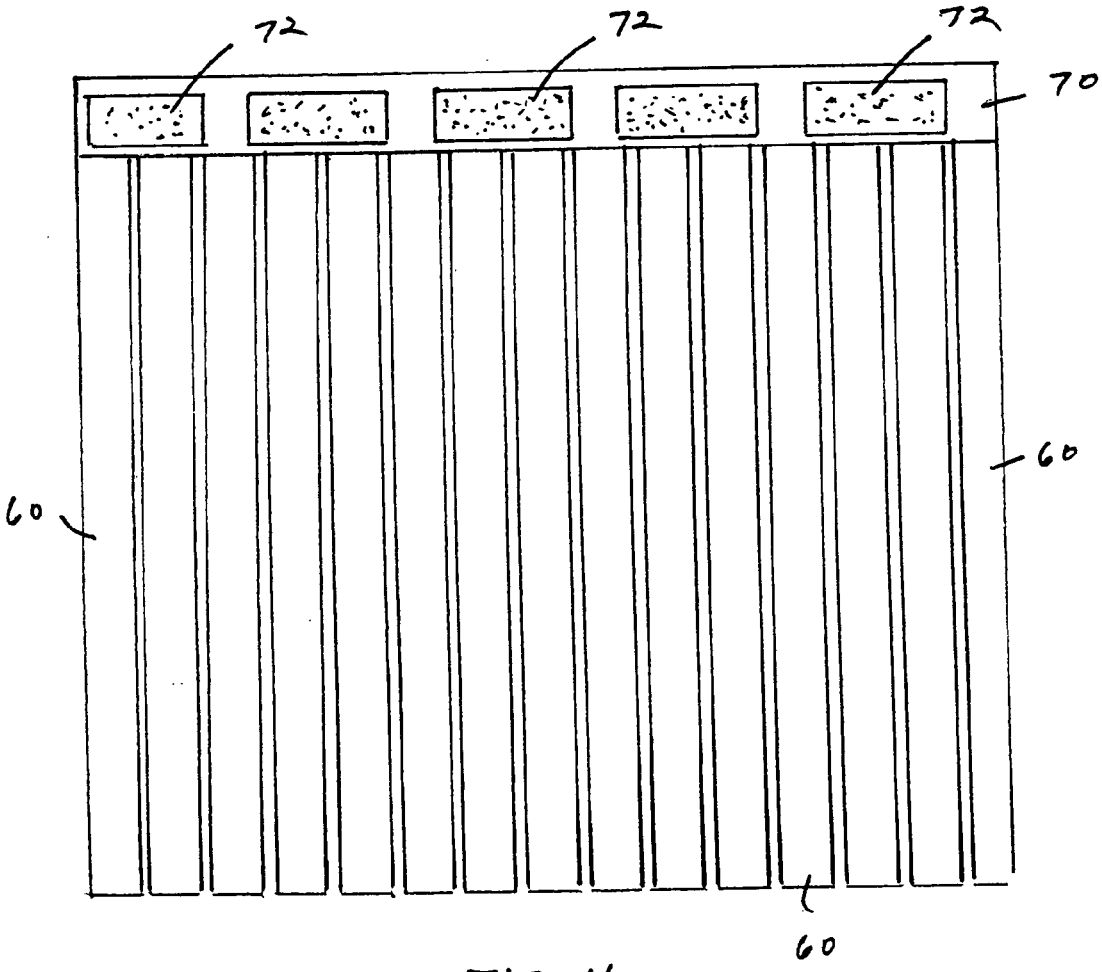
FIG. 4 is a side view of the flexible material strips as used on the crossbar of the present invention.

FIG. 3 shows a detailed view of the crossbar 18. In FIG. 3, the crossbar 18 has a hook-and-loop material 62 affixed thereto and extending therealong. As such, the hook-and-loop material 62 will provide a suitable area whereby various types of flexible members can be secured to the crossbar 18. For example, in FIG. 4, a plurality of flexible strips 60 (such as that illustrated in FIG. 2) are illustrated. A band 70, at the top of the flexible strips 60, will allow the strips 60 to hang downwardly therefrom in generally parallel relationship to each other. The band 70 has several hook-and-loop material patches 72 secured thereto. These hook-and-loop material patches 72 are complementary to the hook-and-loop material strips 62 shown in FIG. 3. As such, the plurality of flexible strips 60 can be properly secured to the crossbar 80 by conventionally pressing the patches 72 onto the strips 62.

Figure 5:
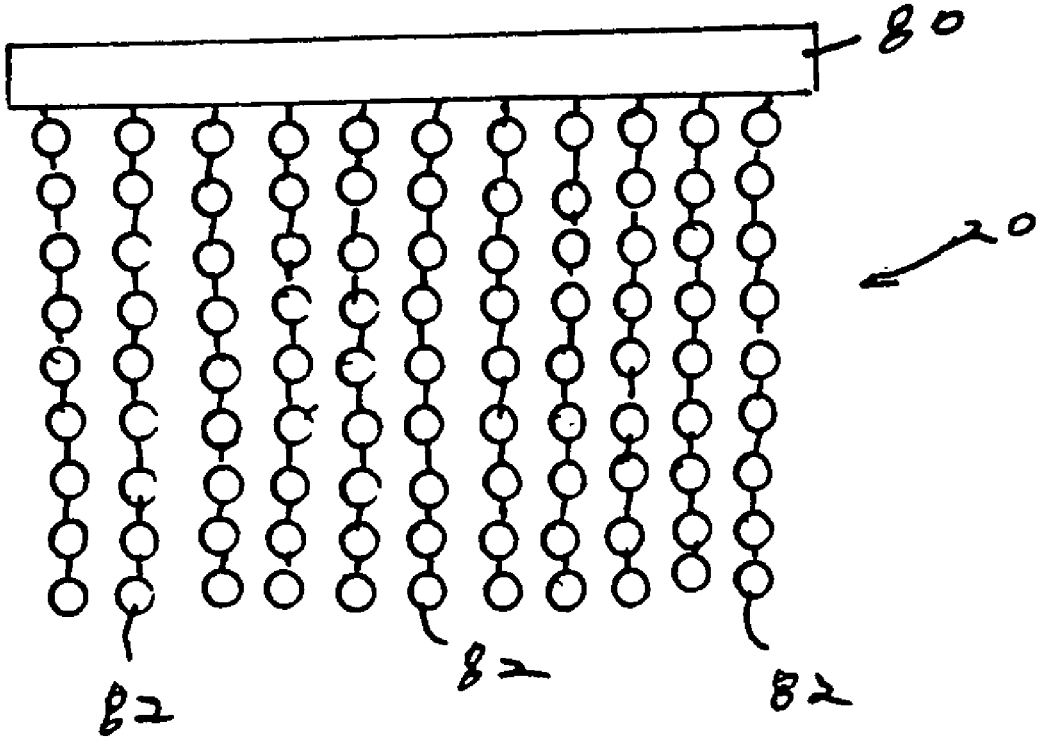
FIG. 5 is a side elevational view of an alternative embodiment of the flexible members as used in the present invention.

FIG. 5 shows an alternative embodiment of the plurality of flexible members 20. In FIG. 5, it can be seen that a band 80 has several beaded lines 82 extending downwardly therefrom. Band 80 can have a similar configuration, with suitable hook-and-loop material patches, such as that shown in FIG. 4. The beaded lines 82 will extend downwardly for a suitable length for rubbing over the human body. The beaded lines 82 will provide a different tactile sensation than that of the flexible strands of FIG. 1 or of the flexible strips of FIGS. 2 and 4.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A body stroking device apparatus comprising:

a housing having a channel extending longitudinally therealong;

an arm extending outwardly of said housing through said channel and vertically upwardly therefrom, said arm comprising an L-shaped member having a lower portion extending outwardly through said channel, said arm further comprising:

a receptacle formed at a top of said L-shaped member; and a rod having an end detachably received in said top of said L-shaped member and extending only upwardly therefrom;

a cross member extending outwardly transversely to said arm, said cross-bar having a hook-and-loop material affixed to an exterior surface thereof;

a plurality of flexible members affixed to said crossbar and extending downwardly therefrom, said plurality of flexible members having a surface with a strip of complementary hood-and-loop material removably secured to said hook-and-loop material of said crossbar, said plurality of flexible members extending downwardly from said crossbar for a distance less than a length of said rod; and translation means connected to said housing for moving said arm longitudinally along said channel.

2. The apparatus of claim 1, said crossbar being affixed to said rod.

3. The apparatus of claim 2, said crossbar comprising a clamp secured to said rod, said clamp for adjusting a height of said crossbar along said rod.

4. The apparatus of claim 1, said plurality of flexible members comprising:

a plurality of flexible strips extending downwardly from said crossbar in generally parallel relationship to each other.

5. The apparatus of claim 1, said plurality of flexible members comprising:

a plurality of beaded lines extending downwardly from said crossbar.

6. The apparatus of claim 1, said plurality of flexible members comprising:

a plurality of flexible strands extending downwardly from said crossbar.

7. The apparatus of claim 1, further comprising:

a mat with a surface suitable for receiving a human body thereon, said mat positioned adjacent a side of said housing, said crossbar extending over a top of said mat.

8. The apparatus of claim 1, said translation means for moving said arm back and forth from one end of said channel to another end of said channel.

9. A body stroking apparatus comprising:

a housing having a generally flat surface;

an arm extending outwardly from said housing and upwardly therefrom;

a crossbar affixed to said arm and extending outwardly therefrom;

a plurality of flexible members affixed to said crossbar and extending downwardly therefrom; and a translation means connected to said housing for moving said arm along a length of said housing, said housing having a channel extending longitudinally therealong, said arm extending through said channel, said translation means for moving said arm back and forth in said channel, said crossbar extending outwardly from a side of said arm opposite said housing, said crossbar comprising a clamp secured to said arm, said clamp for adjusting a height of said crossbar along a vertical portion of said arm, said crossbar having a hook-and-loop material affixed to an exterior surface thereof, said plurality of flexible members having a surface with a strip of complementary hook-and-loop material secured to said hook-and-loop material of said crossbar, said plurality of flexible members extending downwardly from said crossbar for a distance less than a vertical length of said arm, said arm comprising a L-shaped member having a lower portion extending outwardly through said channel.

* * * * *